US005960876A

United States Patent [19]

Wiedemann

[11] Patent Number: 5,960,876

[45] Date of Patent: Oct. 5, 1999

[54] WELLHEAD EQUIPMENT THAT USE POLYMER SEALING ELEMENTS TO SEAL OFF WELL PRESSURE

[75] Inventor: Jim Lee Wiedemann, Edmonton, Canada

[73] Assignee: Vanoil Equipment Inc., Leduc, Canada

[21] Appl. No.: 09/012,289

[22] Filed: Jan. 23, 1998

[51] Int. Cl.[6] ..... E21B 33/04

[52] U.S. Cl. ..... 166/84.2; 166/368

[58] Field of Search ..... 166/84.2, 373, 166/368, 84.3

[56] References Cited

U.S. PATENT DOCUMENTS

| | | | |
|---|---|---|---|
| 2,674,474 | 4/1954 | Lister | 166/84.2 |
| 4,480,843 | 11/1984 | Springer | 166/173 X |
| 4,697,639 | 10/1987 | Caraway et al. | 166/84.2 |
| 5,163,514 | 11/1992 | Jennings | 166/368 |
| 5,255,743 | 10/1993 | Adam et al. | 166/345 |
| 5,549,156 | 8/1996 | D'Alfonoso et al. | 166/84.2 X |
| 5,865,245 | 2/1999 | Trout et al. | 166/84.2 |

*Primary Examiner*—Frank Tsay
*Attorney, Agent, or Firm*—Davis and Bujold

[57] ABSTRACT

Wellhead equipment includes a body having a drilling conduit passage, whereby drilling conduit is passed through the body. Polymer sealing elements are disposed within the body and disposed in relation to the passage to seal off well pressure. A circulation passage extends through the body in the vicinity of the polymer sealing elements. The circulation passage has an inlet and an outlet whereby warm fluid is circulated through the circulation passage from the inlet to the outlet thereby raising the temperature of the polymer sealing elements to improve their cold weather performance.

2 Claims, 7 Drawing Sheets

WELLHEAD EQUIPMENT THAT USE POLYMER SEALING ELEMENTS TO SEAL OFF WELL PRESSURE

FIELD OF THE INVENTION

The present invention relates to wellhead equipment that use polymer sealing elements to seal off well pressure and, in particular, such equipment known as blow out preventers.

BACKGROUND OF THE INVENTION

Wellhead blow out prevention equipment uses polymer sealing elements to seal off well pressure. When these polymer sealing elements become cold their elastomer properties decrease, resulting in a corresponding decrease in the reliability of the wellhead blow out prevention equipment.

SUMMARY OF THE INVENTION

What is required is wellhead equipment which is better suited for cold weather use.

According to one aspect of the present invention there is provided wellhead equipment that includes a body having a drilling conduit passage, whereby drilling conduit is passed through the body. Means is provided for securing the body to a wellhead. Polymer sealing elements are disposed within the body and disposed in relation to the passage to seal off well pressure. A circulation passage extends through the body in the vicinity of the polymer sealing elements. The circulation passage has an inlet and an outlet whereby warm fluid is circulated through the circulation passage from the inlet to the outlet thereby raising the temperature of the polymer sealing elements to improve their cold weather performance.

According to another aspect of the present invention there is provided the wellhead equipment, as described above, in combination with a source of warm fluid and a pump. The pump circulates the warm fluid through the circulation passage from the inlet to the outlet thereby raising the temperature of the polymer sealing elements to improve their cold weather performance.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
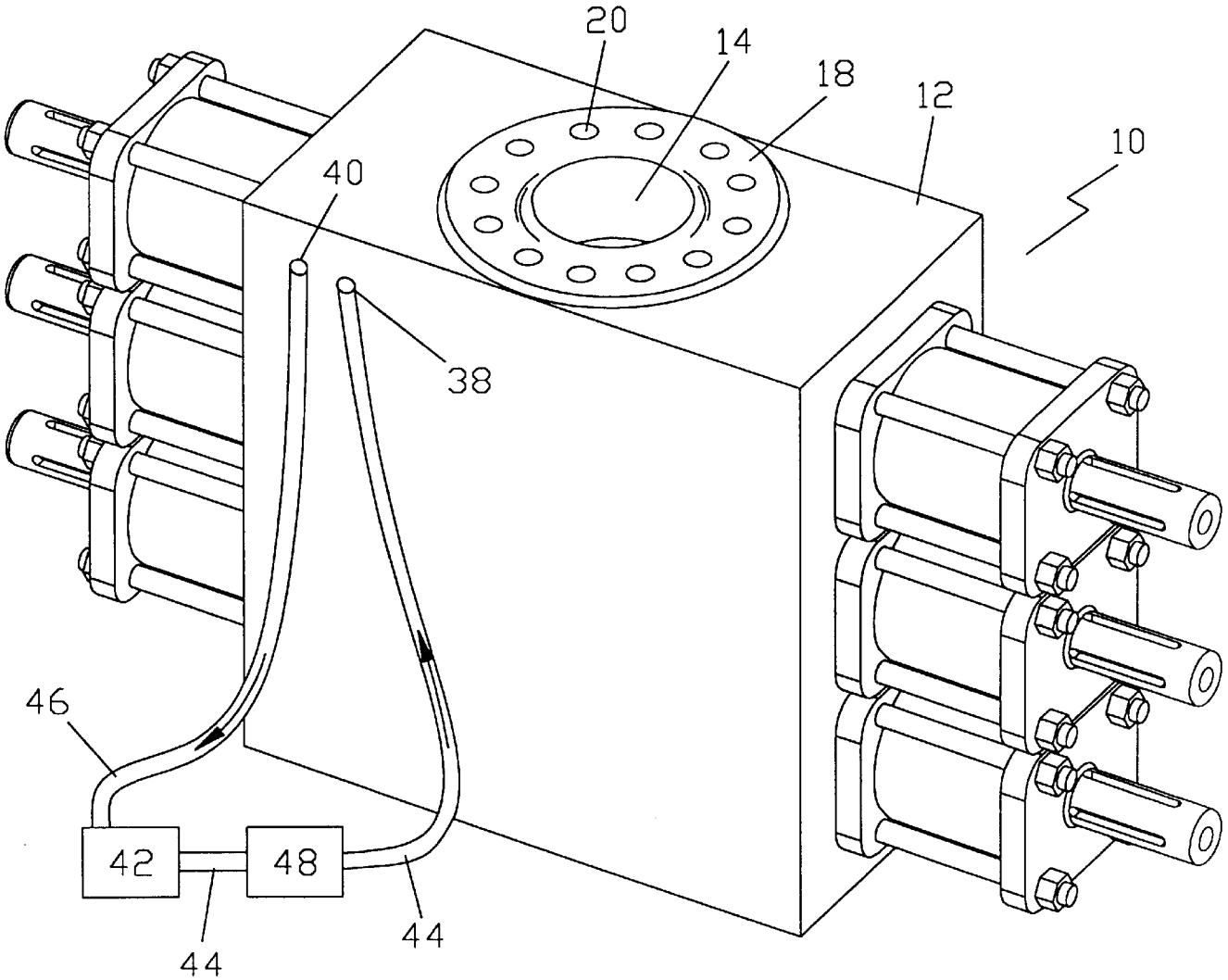
FIG. 1 is a perspective view of a first embodiment of blow out preventer constructed in accordance with the teachings of the present invention.

It will now be illustrated how the teachings of the present invention may be applied to a selected piece of wellhead equipment, namely a blow out preventer. Two styles of blow out preventer in common usage have been illustrated. A first embodiment, generally identified by reference numeral 10, will be described with reference to FIGS. 1 through 4. A second embodiment, generally identified by reference numeral 11, will be illustrated with reference to FIGS. 5 through 7.

Figure 2:
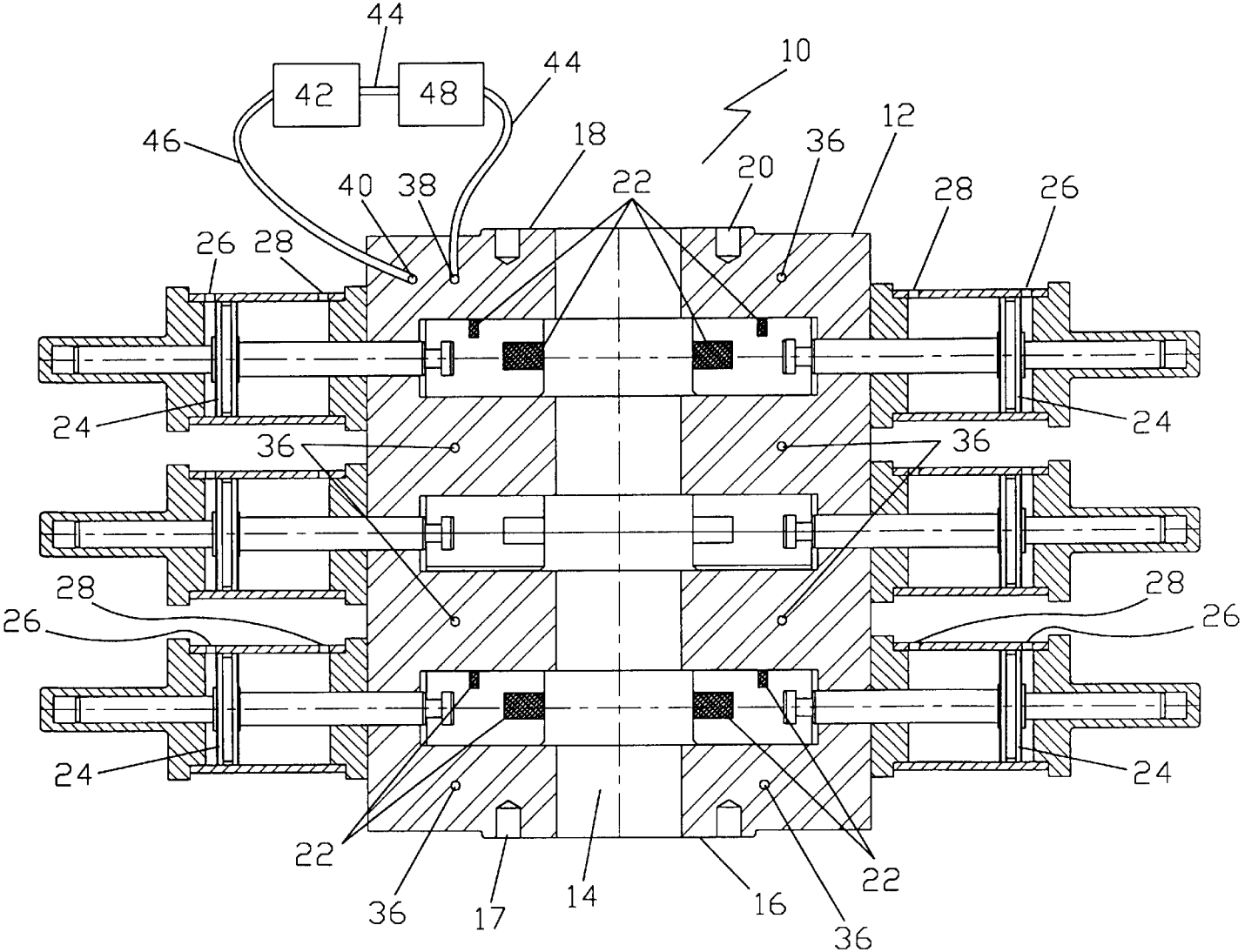
FIG. 2 is an end elevation view, in section, of the first embodiment of blow out preventer illustrated in FIG. 1, with hydraulic piston in a first or retracted position and polymer sealing elements in their non-deformed position.
Figure 3:
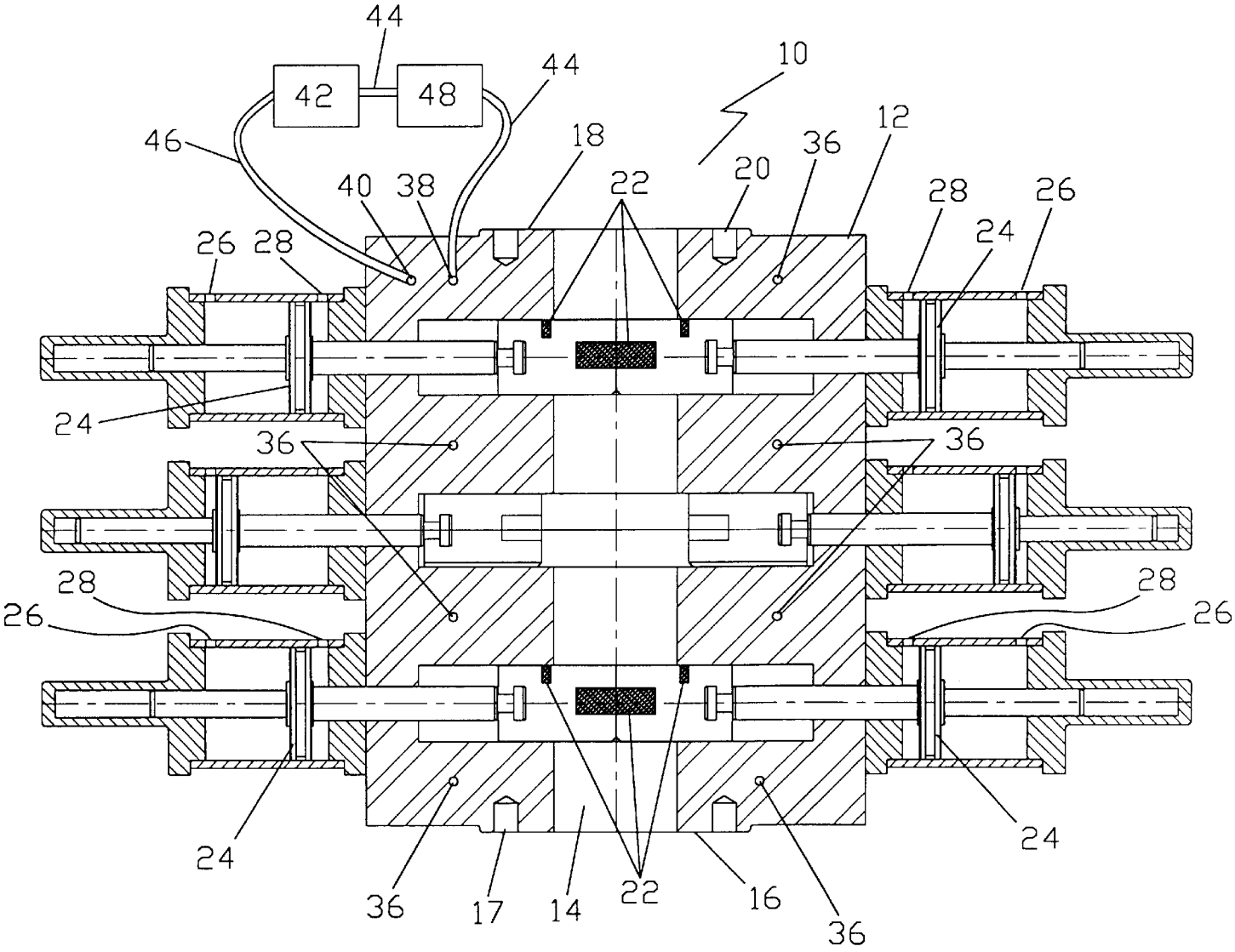
FIG. 3 is an end elevation view, in section, of the first embodiment of blow out preventer illustrated in FIG. 1, with hydraulic piston in a second or extended position.
Figure 4:
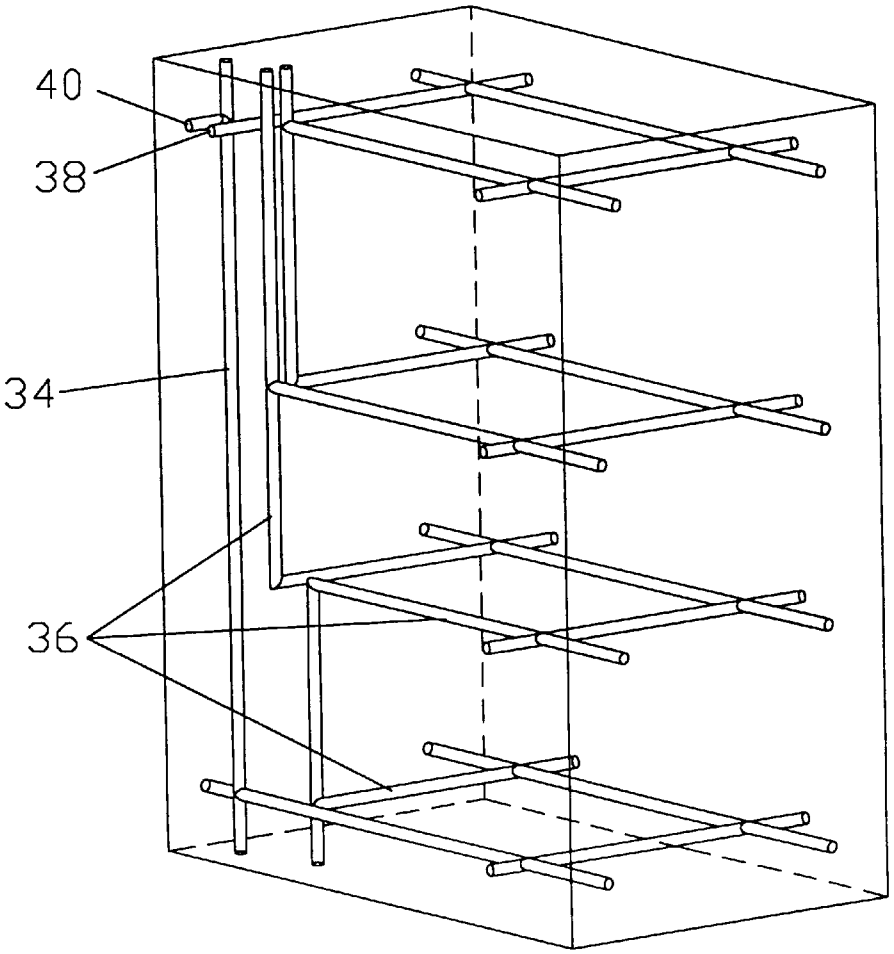
FIG. 4 is a perspective view of circulation passages in the first embodiment of blow out preventer illustrated in FIG. 1.

Referring to FIG. 1, blow out preventer 10 includes a body 12 having a drilling conduit passage 14, whereby drilling conduit (not shown) is passed through body 12. Referring to FIG. 2, a mounting flange 16 is provided as means for securing body 12 to a wellhead (not shown). Mounting flange 16 has a plurality of threaded apertures 17. Referring to FIG. 1, an annular mounting surface 18 is provided which has a plurality of threaded apertures 20 by means of which other wellhead equipment is secured to body 12. Referring to FIG. 2, polymer sealing elements 22 are disposed within body 12. An hydraulically activated piston 24 is movable between a first or retracted position illustrated in FIG. 2 and a second or extended position illustrated in FIG. 3. In the second or extended position piston 24 exerts a force which deforms polymer sealing elements 22 causing them to seal off passage 14 from well pressure. Movement of piston 24 to the second or extended position is effected by pumping hydraulic fluid in through passage 26 while bleeding hydraulic fluid out through passage 28. Returning piston 24 to the first or retracted position is effected by pumping hydraulic fluid in through passage 28 while bleeding hydraulic fluid out through passage 26. Referring to FIG. 4, a circulation passage 34 is provided through body 12. Circulation passage 34 has a network of individual circulation lines 36 positioned in that portion of body 12 surrounding the vicinity of polymer sealing elements (not shown). Circulation passage 34 has an inlet 38 and an outlet 40.

The use and operation of blow out preventer 10 will now be described with reference to FIGS. 1 through 4. Referring to FIG. 1, blow out preventer 10 is connected to a source of warm fluid 42 by an input flow line 44 connected to inlet 38 of circulation passage 34 and an output flow line 46 connected to outlet 40 of circulation passage 34. A pump 48 is then coupled to input flow line 44 to pump warm fluid from source 42 through circulation passage 34. The circulation of warm fluid through circulation passage 34 from inlet 38 to outlet 40 serves to raise the temperature of body 12 and polymer sealing elements 22 housed within body 12 to improve the cold weather performance of polymer sealing elements 22.

Figure 5:
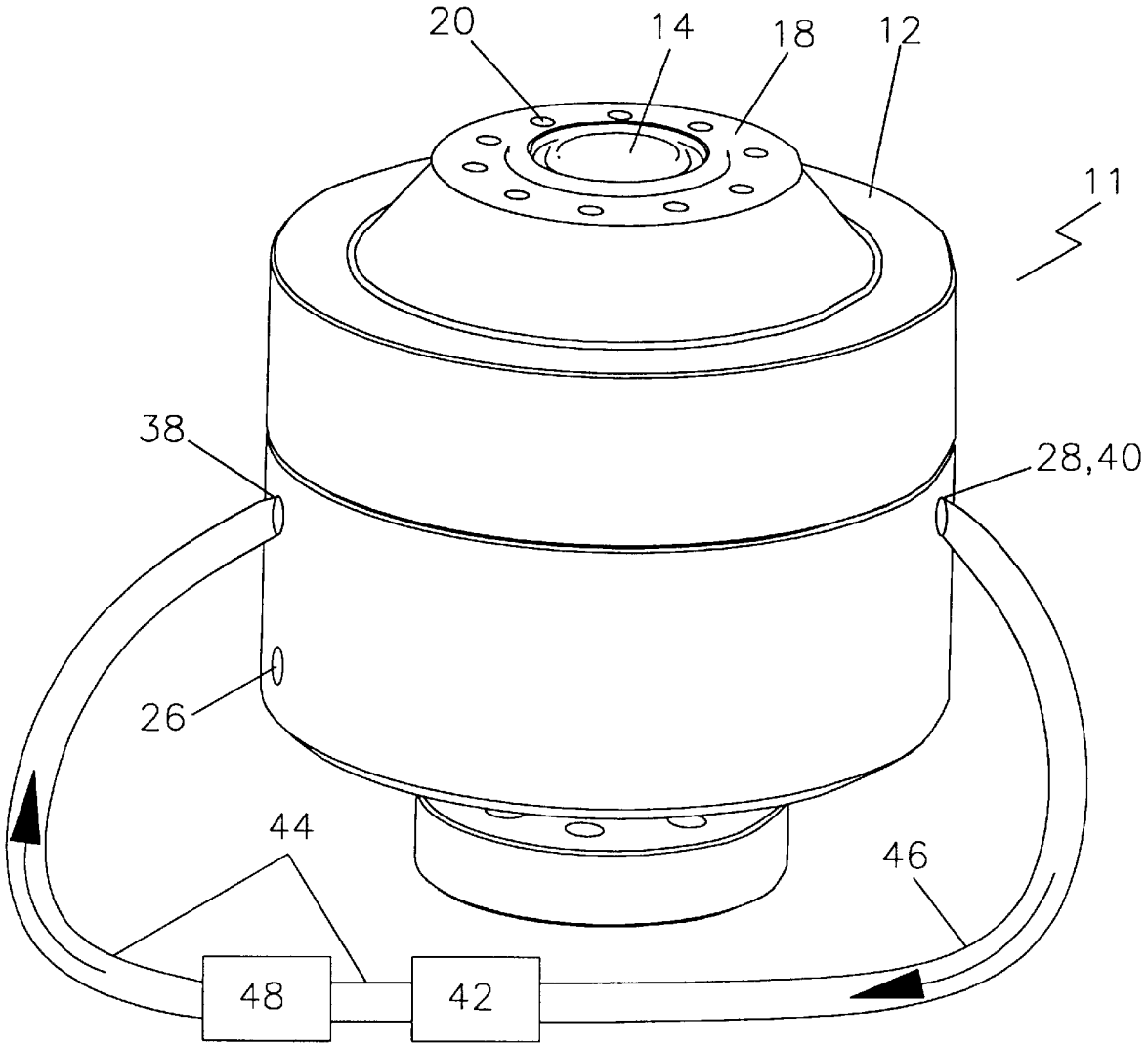
FIG. 5 is a perspective view of a second embodiment of blow out preventer constructed in accordance with the teachings of the present invention.
Figure 6:
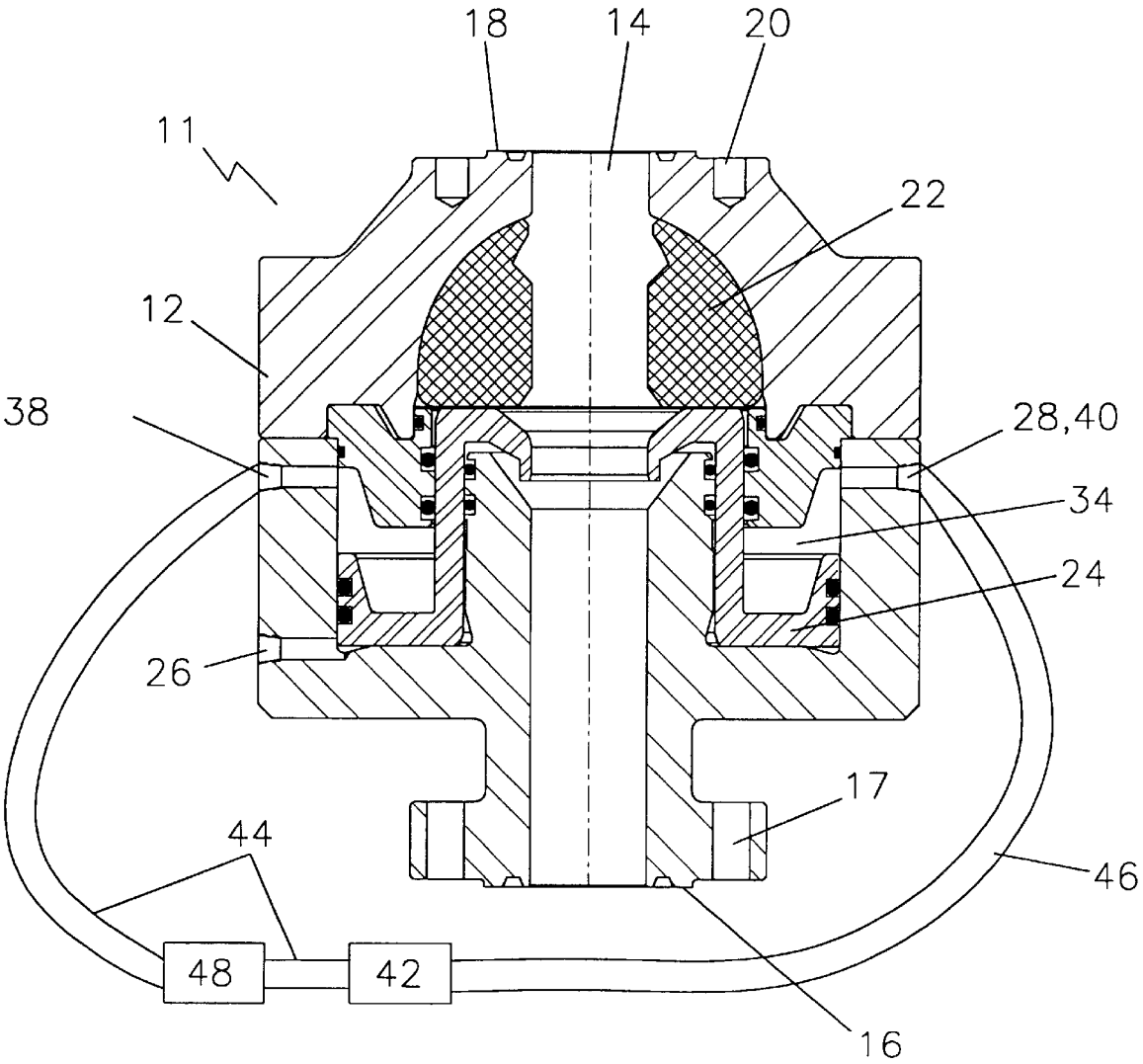
FIG. 6 is an side elevation view, in section, of the second embodiment of blow out preventer illustrated in FIG. 5, with hydraulic piston in a first or retracted position and polymer sealing elements in their non-deformed position.
Figure 7:
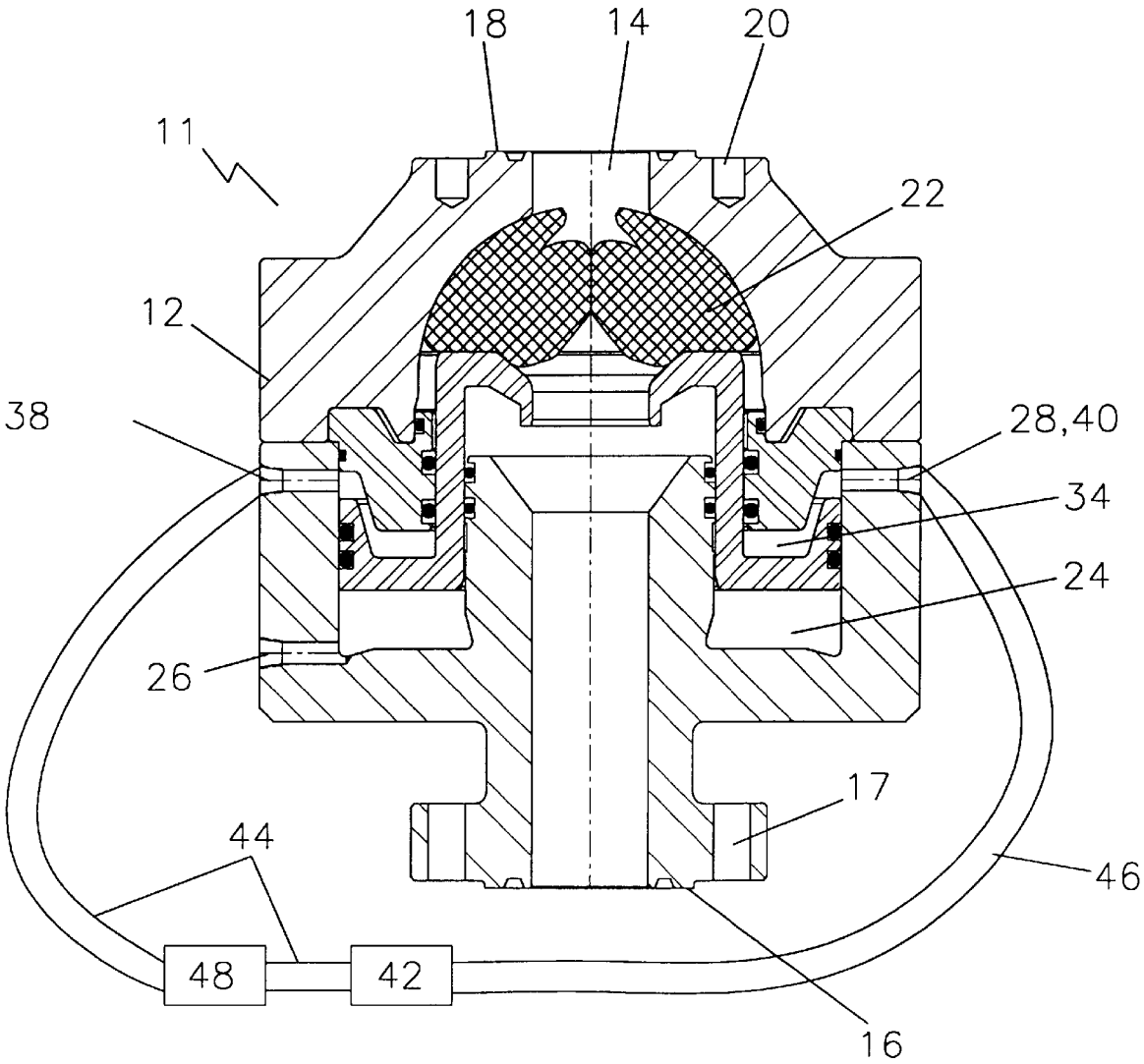
FIG. 7 is an end elevation view, in section, of the second embodiment of blow out preventer illustrated in FIG. 5, with hydraulic piston in a second or extended position.

In the description of blow out preventer 11, the same reference numerals will be used as were used in the description of first embodiment 10 to describe elements that perform similar functions. Referring to FIG. 5, blow out preventer 11 includes a body 12 having a drilling conduit passage 14, whereby drilling conduit (not shown) is passed through body 12. Referring to FIG. 6, a mounting flange 16 is provided as means for securing body 12 to a wellhead (not shown) . Mounting flange 16 has a plurality of bolt receiving apertures 17. Referring to FIG. 5, an annular mounting surface 18 is provided which has a plurality of threaded apertures 20 by means of which other wellhead equipment is secured to body 12. Referring to FIG. 6, a single polymer sealing element 22 is disposed within body 12. An hydraulically activated piston 24 is movable between a first or retracted position illustrated in FIG. 6 and a second or extended position illustrated in FIG. 7. In the second or extended position piston 24 exerts a force which deforms polymer sealing elements 22 causing them to seal off passage 14 from well pressure. Movement of piston 24 to the second or extended position is effected by pumping hydraulic fluid in through passage 26 while bleeding hydraulic fluid out through passage 28. Returning piston 24 to the first or retracted position is effected by pumping hydraulic fluid in through passage 28 while bleeding hydraulic fluid out through passage 26. As can be seen from an examination of FIG. 5, with second embodiment 11 body 12 is round. It is extremely difficult to drill a circulation passage with a plurality of individual circulation lines through a round body, therefore, an approach that differs from that illustrated with respect to first embodiment 10 is required. Referring to FIGS. 6 and 7, with second embodiment 11, the hydraulic fluid used to move piston 24 is already positioned in a hydraulic chamber in the vicinity of polymer sealing elements 22; this means that a ready made circulation passage 34 exists. An additional inlet passage 38 is made communicating with the hydraulic chamber (circulation passage 34). Existing passage 28 can serve as an outlet 40 to for the circulation of hydraulic fluid.

The use and operation of blow out preventer 11 will now be described with reference to FIGS. 5 through 7. Referring to FIG. 5, blow out preventer 11 is connected to a source of warm fluid 42 by an input flow line 44 connected to inlet 38 and an output flow line 46 connected to outlet 40 of circulation passage 34. A pump 48 is then coupled to input flow line 44 to pump warm fluid from source 42 through the existing hydraulic chamber which serves as circulation passage 34. The circulation of warm fluid through hydraulic chamber (circulation passage 34) from inlet 38 to outlet 40 serves to raise the temperature of body 12 and polymer sealing elements 22 housed within body 12 to improve the cold weather performance of polymer sealing elements 22.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. Wellhead equipment, comprising:

a body having a drilling conduit passage, whereby drilling conduit is passed through the body;

means for securing the body to a wellhead;

polymer sealing elements disposed within the body and disposed in relation to the passage to seal off well pressure;

a circulation passage through the body in the vicinity of the polymer sealing elements, the circulation passage having an inlet and an outlet whereby warm fluid is circulated through the circulation passage from the inlet to the outlet thereby raising the temperature of the polymer sealing elements to improve their cold weather performance.

2. In combination:

wellhead equipment, comprising:

a body having a drilling conduit passage, whereby drilling conduit is passed through the body;

means for securing the body to a wellhead;

polymer sealing elements disposed within the body and disposed in relation to the passage to seal off well pressure;

a circulation passage through the body in the vicinity of the polymer sealing elements, the circulation passage having an inlet and an outlet;

a source of warm fluid; and a pump circulating the warm fluid through the circulation passage from the inlet to the outlet thereby raising the temperature of the polymer sealing elements to improve their cold weather performance.

* * * * *